United States Patent [19]

Trützschler

[11] 4,176,425

[45] Dec. 4, 1979

[54] DEVICE FOR SUPPORTING TEXTILE FIBER BALES DURING BALE BREAKING

[75] Inventor: Hermann Trützschler, Mönchen-Gladbach, Fed. Rep. of Germany

[73] Assignee: Trützschler GmbH & Co. KG, Mönchen-Gladbach, Fed. Rep. of Germany

[21] Appl. No.: 876,149

[22] Filed: Feb. 8, 1978

[30] Foreign Application Priority Data

Feb. 11, 1977 [DE] Fed. Rep. of Germany ..... 2705688

[51] Int. Cl.[2] ..... D01G 7/06

[52] U.S. Cl. ..... 19/81; 294/63 A

[58] Field of Search ..... 19/80 R, 81, 145.5; 294/63 A, 67 BA, 93, 99 R; 241/101 A, 281; 198/621, 736, 747

[56] References Cited

U.S. PATENT DOCUMENTS

| | | | |
|---|---|---|---|
| 2,609,113 | 9/1952 | Huffman | 294/63 A |
| 2,938,239 | 5/1960 | Leineweber, Jr. et al. | 19/80 R |
| 3,208,106 | 9/1965 | Leineweber, Jr. et al. | 19/80 R |
| 3,716,264 | 2/1973 | Pearne et al. | 294/93 X |
| 3,831,995 | 8/1974 | Duncan | 294/63 A X |

FOREIGN PATENT DOCUMENTS

| | | | |
|---|---|---|---|
| 2421192 | 11/1974 | Fed. Rep. of Germany | 294/63 A |

*Primary Examiner*—Dorsey Newton
*Attorney, Agent, or Firm*—Spencer & Kaye

[57] ABSTRACT

A bale breaker machine includes a breaker arrangement on which a textile fiber bale is positioned for being opened at its underside, a guiding wall pair formed of two substantially vertically oriented bale guiding wall disposed above the breaker arrangement and spaced from one another to accommodate the textile fiber bale therebetween; and a bale supporting device which includes an insert carried by at least one bale guiding wall at a face thereof oriented to the other bale guiding wall of the guiding wall pair and a displacing arrangement coupled to the insert for moving at least one part of the insert away from the associated bale guiding wall and for urging the insert part into a face-to-face engagement with a side of the textile fiber bale positioned between the bale guiding walls of the guiding wall pair.

10 Claims, 5 Drawing Figures

FIG. 1
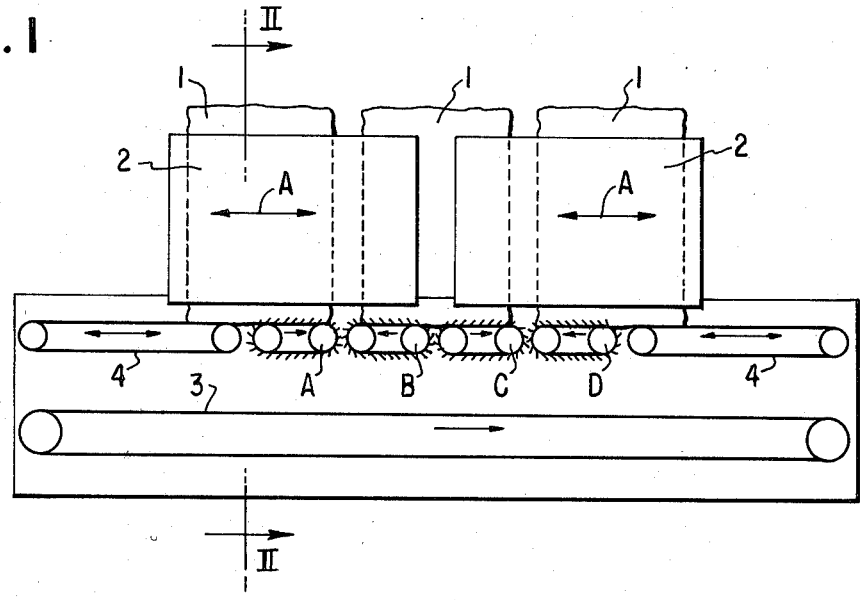
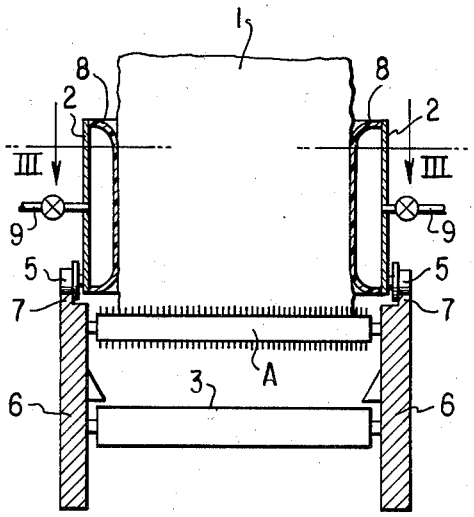
FIG. 2
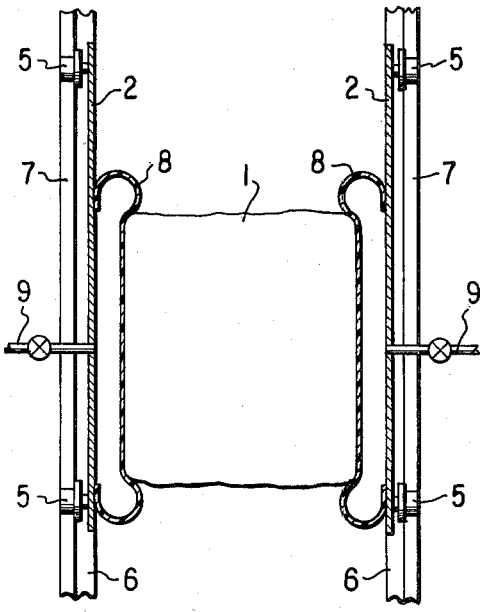
FIG. 3

DEVICE FOR SUPPORTING TEXTILE FIBER BALES DURING BALE BREAKING

BACKGROUND OF THE INVENTION

This invention relates to a device for supporting textile fiber bales during the bale breaking operation. The apparatus includes vertically oriented lateral bale guiding walls between which a row of textile fiber bales are positioned and which are movable back and forth with the bales as the bale breaking operation is performed at the bottom thereof.

An apparatus of the above-outlined type is known and is disclosed, for example, in German Pat. No. 2,018,445. The apparatus described in this patent includes a conveying device having upwardly and downwardly open housings for receiving, supporting and advancing a number of textile fiber bales in the longitudinal direction from portions of a baseplate along breaker devices arranged underneath the baseplate. The housings have carrying devices, behind which the carrier pins of a conveying chain project to thus move the housings with the textile fiber bales along the baseplate. The textile fiber bales expand as, during operation, the bale ties are removed from the textile fiber bales that were, up to that moment, firmly compressed by the bale ties. The expanded (relaxed) textile fiber bales have various dimensions. If now such relaxed textile fiber bales are inserted in the housings, an intermediate space is present between the bale and the bale guiding walls of the housing in case the textile fiber bale does not entirely fill out the respective housing. This results in an undesired play of the textile fiber bale, so that a firm and secure guidance over the breaker mechanism cannot be ensured. It is further of disadvantage that in such an arrangement the housings have additional intermediate spaces between one another in the working direction (that is, in the direction of bale advance) between the transverse separating walls, so that the textile fiber bales cannot be positioned serially closely together.

SUMMARY OF THE INVENTION

It is an object of the invention to provide, in a bale breaker machine, an improved device for supporting textile fiber bales from which the above-discussed disadvantages are eliminated and which thus makes possible a firm support and stable positioning of the textile fiber bales of any shape and dimension during the bale breaking process.

This object and others to become apparent as the specification progresses, are accomplished by the invention, according to which, briefly stated, the bale breaker machine includes a breaker arrangement on which a textile fiber bale is positioned for being opened at its underside, a guiding wall pair formed of two substantially vertically oriented bale guiding walls disposed above the breaker arrangement and spaced from one another to accommodate the textile fiber bale therebetween; and a bale supporting device which includes an insert carried by at least one bale guiding wall at a face thereof oriented to the other bale guiding wall of the guiding wall pair and a displacing arrangement coupled to the insert for moving at least one part of the insert away from the associated bale guiding wall and for urging the insert part into a face-to-face engagement with a side of the textile fiber bale positioned between the bale guiding walls of the guiding wall pair.

By providing a displaceable insert between the bale guiding walls and the textile fiber bales, a stable support of the textile fiber bale is ensured since the insert, by virtue of its mobility, can be caused to engage the textile fiber bale independently from the dimensions and shape thereof.

The textile fiber bales which may have, for example, different width and/or height dimensions, are first positioned between the bale guiding walls and subsequently the respective inserts are moved transversely in the direction of the associated textile fiber bale until they lie against a bale side in a face-to-face relationship. In this manner, a firm support and thus a stable positioning of the textile fiber bales of any shape and dimension is made possible during the bale breaking process. Further, by omitting, in contrast to known apparatus, transverse closure walls and eliminating intermediate spaces that separate the textile fiber bales from one another, there is ensured a close serial arrangement of the textile fiber bales.

According to a preferred embodiment of the invention, the bale guiding walls are connected by a horizontal lid plate and further, the insert is provided over the entire surface of the bale guiding walls and the lid plate. In this manner, a support arrangement moving longitudinally with the textile fiber bale as a unit is ensured not only for the lateral bale sides but also for the top side. Preferably, pressurized air may be introduced into the zone between the bale guide walls and/or the lid plate and the movable insert. In this manner, the insert associated with the lid plate can continuously follow the changing bale height as it decreases during the bale breaking. Expediently, the pressurized air is introduced by means of a unit which can be set for blowing or for vacuum operation. In this manner, not only can the insert be expanded by pressurized air but, when the unit is switched over to vacuum operation, the insert can again be withdrawn in the direction of the bale guiding walls and the lid plate in order to free the space for the introduction of a new textile fiber bale.

Preferably, the insert is made of a dense fabric which is flexible to thus lie firmly on the bale guiding walls and the lid plate and to cause it to expand in the direction of the textile fiber bales. Tent canvas fabric has been found advantageous because of its high strength. The insert material may be further a synthetic sheet. Such a material may be made in a very economical manner and may be reinforced, for example, by high-strength filaments or the like. Rubber is also considered as an advantageous material which, because of its elasticity, conforms readily to the surface of the textile fiber bales. Or, it may be particularly advantageous if the insert is made of a composite material. Such a material, which may be, for example, a rubber-coated fabric, has the advantage that it is airtight and is highly resistant to wear and rupture.

The insert may be closed on all sides to thus have a bag-like or bellows-like configuration that may be manufactured in an economical manner. In the alternative, the insert may be sealed to the bale guiding walls or the lid plate in an airtight manner. Such an arrangement has the advantage that no deposits can accumulate in the intermediate space between the insert and the bale guiding walls and the lid plate.

According to a particularly advantageous feature of the invention, the insert is at least indirectly connected to its associated guide wall (or the lid plate) by an elastic connecting member which retracts the insert from the zone of the textile fiber bale after the air pressure—which caused the expansion of the insert—is removed.

BRIEF DESCRIPTION OF THE DRAWINGS

FIG. 1 is a schematic side elevational view of a bale breaking machine incorporating the invention.

FIG. 2 is a schematic sectional view taken along line II—II of FIG. 1, illustrating a preferred embodiment of the invention.

FIG. 3 is a schematic sectional view taken along line III—III of FIG. 2.

DESCRIPTION OF THE PREFERRED EMBODIMENTS

Figure 4:
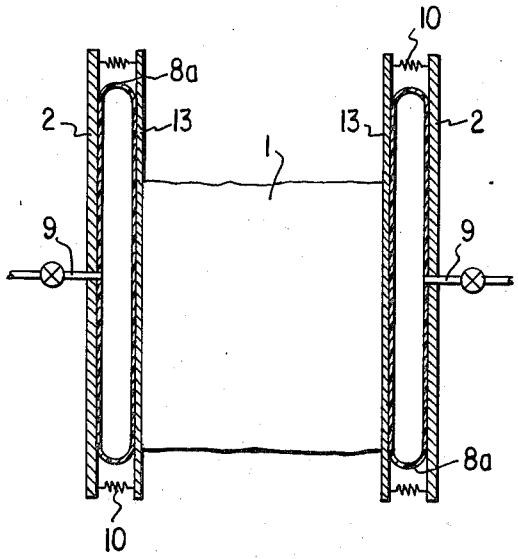
FIG. 4 is a schematic sectional top view of another preferred embodiment of the invention.

Turning now to FIG. 1, there is schematically shown a bale breaker machine having a plurality of serially arranged, short-length breaker aprons A, B, C and D preceded and succeeded by deflector aprons 4. A plurality of serially arranged textile fiber bales 1 are supported on the breaker aprons. In operation, the deflector aprons 4 are moved back and forth, while the breaker aprons A–D are driven unidirectionally, but in alternatingly opposite sense as viewed from apron-to-apron. Thus, while the breaker aprons open the textile fiber bales 1 from the underside, they cause short-distance reciprocation of the bales 1 in the longitudinal direction as indicated by the double-headed arrows A.

Also referring now to FIGS. 2 and 3, above the breaker aprons A–D, along both sides of the bale breaker machine, there are arranged a plurality of bale guiding walls 2. The textile fiber bales 1 are positioned between parallel, transversely opposite guiding walls forming guiding wall pairs. Each wall 2 is movable in the direction of arrows A by means of wheels 5 mounted on rails 7 which, in turn, constitute the upper horizontal longitudinal edge of the frame structure 6 of the bale breaker machine. The speed and direction of motion of the bale guiding walls 2 equal those of the bale breaker transport devices 4 and A–D. The speed (rpm) of the conveying devices may be steplessly regulated. Underneath the bale breaker aprons A–D there is arranged an endless conveyor belt 3 for removing the bale parts torn away from the textile fiber bales 1 by the breaker aprons A–D.

At that face of the guide walls which is oriented towards the respective, transversely aligned guide wall, there is provided a movable insert 8 which is constituted of a sheet material made, for example, of a fiber-reinforced synthetic material and which is, along its edges, attached airtight to the respective bale guiding wall 2. By means of a nipple 9, pressurized air may be introduced into the space enclosed by the bale guiding wall 2 and the insert 8 attached thereto. In this manner, the insert 8 can be inflated and thus caused to engage, in a face-to-face relationship, the textile fiber bale 1, resulting in a firm lateral support thereof.

FIG. 3 shows how the insert 8 can surround the vertical edge portions of the textile fiber bale 1, resulting in a form-fitting support thereof.

Turning now to the embodiment illustrated in FIG. 4, the insert **8*a* arranged at the respective bale guiding wall 2, is itself a fully closed, sealed flexible body which, with one of its sides, engages the guiding wall 2 in a face-to-face relationship and on the opposite side has, also in a face-to-face relationship, a support plate 13. Each support plate 13 is connected with the adjacent respective bale guiding wall 2 by means of resilient members, such as tension springs 10. In operation, the inflated inserts 8*a* press the support plate 13 into engagement with the one and the other side of the textile fiber bale 1. When the pressure is released from the inside of the insert 8*a*, the springs 10 move the respective support plates 13 towards their associated guiding walls 2, thus collapsing the insert 8*a***.

Figure 5:
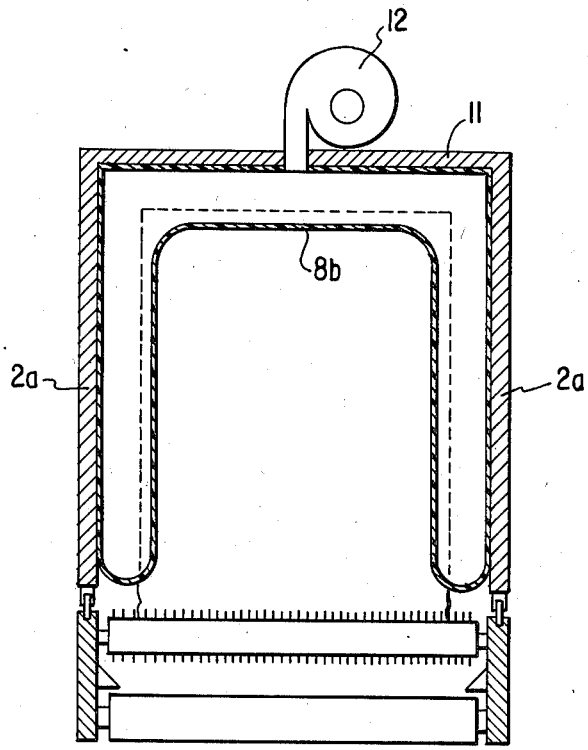
FIG. 5 is a schematic sectional front elevational view of a further preferred embodiment of the invention.

Turning now to the embodiment illustrated in FIG. 5, the two opposite bale guiding walls **2*a* are interconnected with a horizontal lid plae 11. The movable insert 8*b* which, similarly to the FIG. 4 embodiment, is a fully closed, inflatable body, extends along the entire inner face of the two bale guiding walls and the horizontal lid plate 11. To the outside of the horizontal lid plate 11 there is mounted a reversible blower and suction unit 12 for introducing pressurized air into the insert 8*b* (when set for blowing operation) and also for withdrawing air therefrom (when set for suction operation). The unit 12 thus moves together with the bale supporting assembly 2*a*, 8*b* and 11**.

It is noted that, in the embodiment according to FIGS. 2 and 3, it is feasible to substitute a fully closed, inflatable insert for the insert 8 and conversely, in the embodiments according to FIGS. 4 and 5, it is feasible to replace the fully closed insert **8*a* or 8*b* with an insert which is sealed along its edges to the associated guiding wall, similarly to the embodiment shown in FIGS. 2 and 3**.

It will be understood that the above description of the present invention is susceptible to various modifications, changes and adaptations, and the same are intended to be comprehended within the meaning and range of equivalents of the appended claims.

What is claimed is:

1. In a bale breaker machine including breaker means on which a textile fiber bale is positioned for being opened at its underside, a guiding wall pair formed of two substantially vertically oriented bale guiding walls disposed above the breaker means and spaced from one another to accommodate the textile fiber bale therebetween; the improvement comprising (a) a flexible sheet member bounding a sealed chamber and carried by at least one bale guiding wall at a face thereof oriented to the other bale guiding wall of the guiding wall pair;

(b) means for introducing a pressurized medium into said chamber for inflating said flexible sheet member for moving at least one part thereof away from the associated bale guiding wall and for urging said part into a face-to-face engagement with a side of the textile fiber bale positioned between the bale guiding walls of the guiding wall pair; and (c) pressing means for resiliently urging said one part of said flexible sheet member towards said face opposing the force of the pressurized medium in said chamber.

2. A bale breaker machine as defined in claim 1, said pressing means comprising a support plate arranged in a face-to-face relationship with said one part of said flexible sheet member; and spring means attached to said support plate and the associated bale guiding wall for urging said support plate and said one part towards said face.

3. In a bale breaker machine including breaker means on which a textile fiber bale is positioned for being opened at its underside, a guiding wall pair formed of of two substantially vertically oriented bale guiding walls disposed above the breaker means and spaced from one another to accommodate the textile fiber bale therebetween; the improvement comprising (a) a flexible sheet member bounding a sealed chamber and carried by at least one bale guiding wall at a face thereof oriented to the other bale guiding wall of the guiding wall pair;

(b) means for introducing a pressurized medium into said chamber for inflating said flexible sheet member for moving at least one part thereof away from the associated bale guiding wall and for urging said part into a face-to-face engagement with a side of the textile fiber bale positioned between the bale guiding walls of the guiding wall pair; and (c) a horizontal lid plate interconnecting the bale guiding walls that form a guiding wall pair; said flexible sheet member extending along the guiding wall pair and said lid plate.

4. A bale breaker machine as defined in claim 3, wherein said means for introducing a pressurized medium into said chamber comprises a blower unit mounted on said lid plate; further comprising means for movably supporting the guiding wall pair for displacement of the guiding wall pair, the lid plate and the blower unit along the breaker means as a unitary structure.

5. A bale breaker machine as defined in claim 1 or 3, wherein said chamber is, in its entirety, defined by said flexible sheet member.

6. A bale breaker machine as defined in claim 1 or 3, wherein said flexible sheet member has zones sealingly secured to said face and wherein said chamber is defined by said flexible sheet member and said face.

7. A bale breaker machine as defined in claim 1 or 3, further comprising means for movably supporting each bale guiding wall for displacement in its plane along the breaker means.

8. A bale breaker machine as defined in claim 7, wherein said means for introducing a pressurized medium into said chamber comprises a blower unit at least indirectly mounted on said at least one bale guiding wall for moving in unison therewith.

9. A bale breaker machine as defined in claim 1 or 3, wherein said means for introducing a pressurized medium into said chamber comprises a blower unit.

10. A bale breaker machine as defined in claim 9, wherein said blower unit is switchable to blowing or suction operation.

* * * * *